United States Patent [19]

Holmes

[11] 4,327,904

[45] May 4, 1982

[54] ELECTROSTATICALLY ASSISTED RETARD FEEDER METHOD AND APPARATUS

[75] Inventor: Maurice F. Holmes, Brighton, N.Y.

[73] Assignee: Xerox Corporation, Stamford, Conn.

[21] Appl. No.: 145,649

[22] Filed: May 2, 1980

[51] Int. Cl.[3] ..... B65H 3/04; B65H 3/52; B65H 7/12

[52] U.S. Cl. ..... 271/35; 271/121; 271/263; 198/634

[58] Field of Search ..... 271/35, 34, 121, 124, 271/122, 123, 193, 263, 18.1, 18.2, 262, 125, 229, 280, 18, 230, 110, 111, 256, 258, 259, 272, 273, DIG. 3, 281–286, 104, 137, 138, 165–170; 198/691, 460, 634; 414/130; 221/251, 21

[56] References Cited

U.S. PATENT DOCUMENTS

| | | | |
|---|---|---|---|
| 3,493,157 | 2/1970 | Burdorf et al. | 198/691 X |
| 3,635,465 | 1/1972 | Beery | 271/122 |
| 4,159,782 | 7/1979 | Swartzendruber | 271/263 X |

FOREIGN PATENT DOCUMENTS

| | | | |
|---|---|---|---|
| 54-113161 | 9/1979 | Japan | 271/193 |
| 55-48139 | 4/1980 | Japan . | |

*Primary Examiner*—Bruce H. Stoner, Jr.
*Attorney, Agent, or Firm*—Bernard A. Chiama

[57] ABSTRACT

A method and apparatus for selectively increasing the effective frictional force between a retard member and a feed member by making both the feed member and retard member from conductive elastomers, and providing a source of electrical potential to produce an electrical potential between them. A sensor is located downstream of the retard member that will sense a multi-feed of sheets between the pad and retard member. The sensor effects the production of electrical potential thereby increasing the friction between the two members and causing separation of the multi-feed of sheets. The potential is then removed and the frictional forces returned to the original level.

6 Claims, 3 Drawing Figures

ELECTROSTATICALLY ASSISTED RETARD FEEDER METHOD AND APPARATUS

This invention relates to an electrophotographic printing machine, and more particularly, concerns an improved retard feeder in a printing machine.

The sheet separation belt and retard roller appear in the sheet handling art at least as early as 1916 in U.S. Pat. No. 1,167,367 to P. L. Wells and as recently as 1969 in U.S. Pat. No. 3,469,834 to Stange et al. The separation belt and retard roller are employed in these patents for queuing and advancing the sheets but not for separating them from the stack. In the patents, the region of contact between the roller and belt form a sheet queuing throat which is able to "fan out" or queue sheets passed through it. The sheets are separated from a stack and fed to the throat by a presser foot in the Wells, U.S. Pat. No. 1,167,367 and by a nudger or feed wheel in the Stange et al., U.S. Pat. No. 3,469,834.

Present-day, high-speed printing machines, such as, printers, sorters, collators, reproduction machines, etc. can seriously impair their operation if multi-feeds occur. A number of devices of the type disclosed in U.S. Pat. No. 3,768,803 have been employed to minimize the possibility of multi-feeds. Devices of this type are designed to solve three problems that are encountered in bottom feeding sheets from a stack. The first is separating a sheet or sheets from a stack. The second is queuing the separated sheets into an order such as that corresponding to their order in the stack, e.g., outermost sheets followed by the adjacent innermost sheets. The third problem is advancing the queued sheets into the sheet processing system served by the feeding device. The present invention improves over past systems by detecting and separating multi-feeds quickly and effectively.

In accordance with one aspect of the present invention, there is provided an apparatus for sensing the need for increased pressure at the retard nip in a retard feeder and supplying the increased pressure as a result of the sensed need. The apparatus is characterized by a feed belt and retard pad both being electrically connected and made from conductive elastomers. A sensor senses a multi-feed of sheets through the nip formed between the belt and retard pad and actuates a means that is adapted to apply a potential difference between the retard pad and the belt on demand. When the potential is applied, the effective friction force supplied by the materials increases significantly causing a subsequent increase in the frictional separating force of the feeder. When the potential is removed, the friction force returns to the original level.

In accordance with another aspect of the invention, a method for minimizing sheet multi-feeds in a retard feeder having a feed belt and a retard pad is characterized by the steps of: (a) sensing a multi-feed; (b) applying a potential difference between the feed belt and retard pad as a result of said multi-feed sensing; and (c) subsequently removing said potential difference after the multi-feed has been separated.

Other features of the present invention will become apparent as the following description proceeds and upon reference to the drawings in which.

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
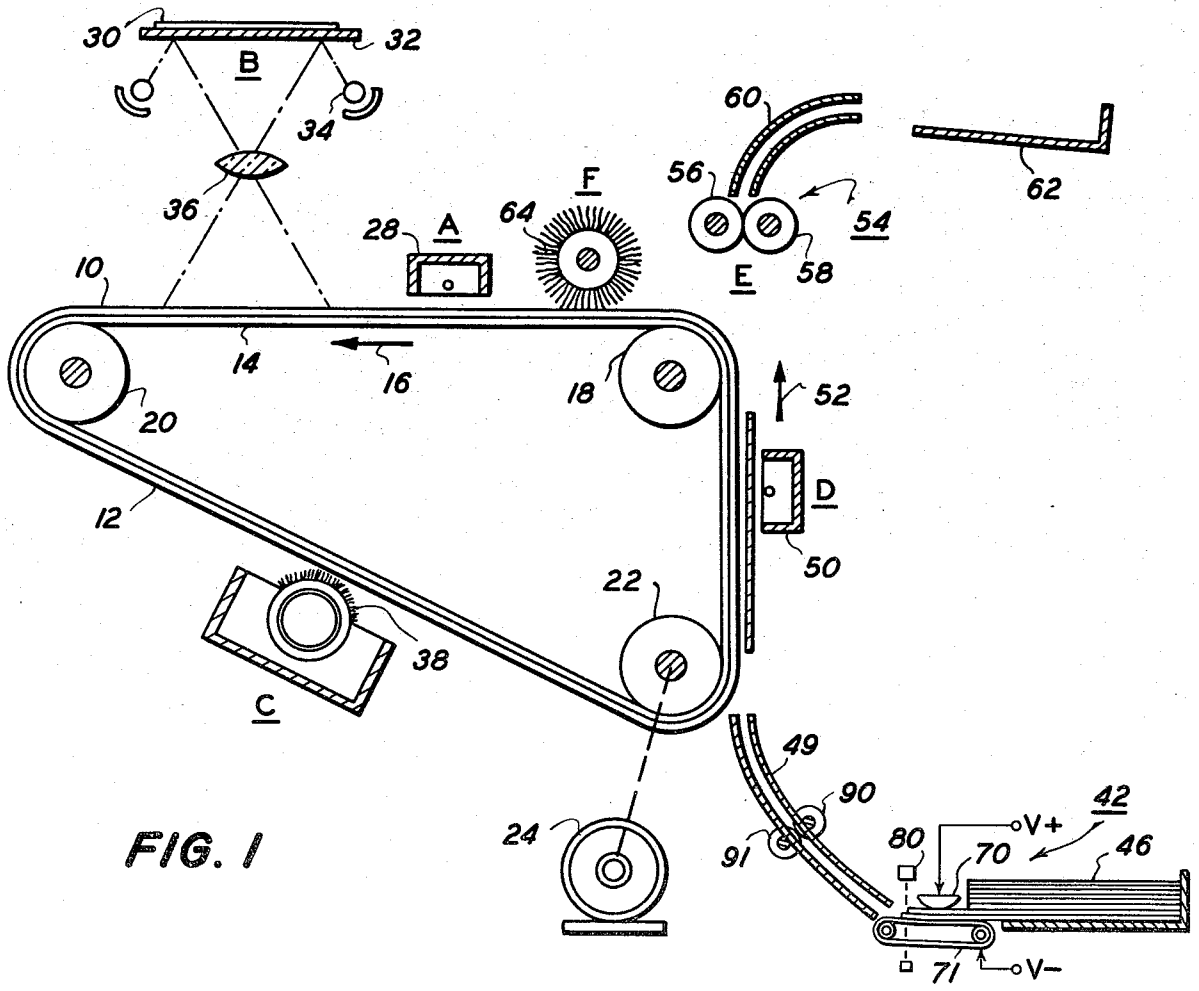
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the electrostatically assisted retard feeder method and apparatus of the present invention therein. It will become evident from the following discussion that the electrostatically assisted retard system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive subtrate 14 being made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductor surface 12 of the belt 10 to a relatively high, substantially uniform potential. A suitable corona generating device is described in U.S. Pat. No. 2,836,725 issued to Vyverberg in 1958.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet of support material is advanced toward transfer station D by retard feeder 42. Preferably, the retard feeder device 42 includes belt 71 and retard pad 70. The belt 71 rotates so as to advance the lowermost sheet from stack 46 into transport guide 49. The sheets are directed into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrostatographic printing machine.

Figure 2:
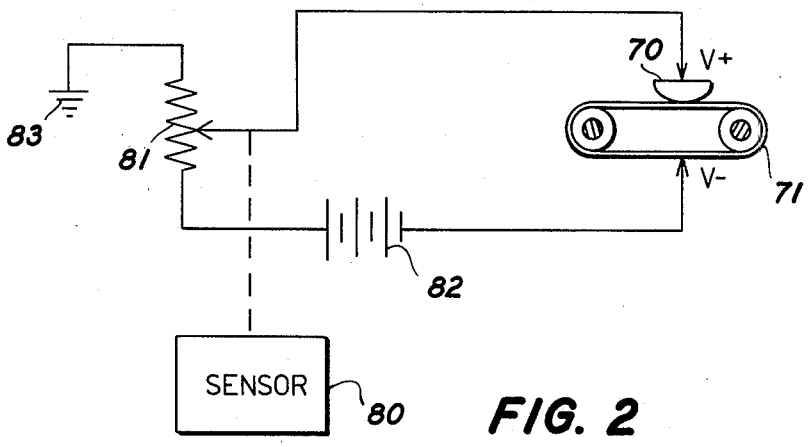
FIG. 2 is a diagramatic illustration employing an aspect of the present invention.

Referring now to an aspect of the subject matter according to the invention, FIG. 2 shows a system employing the invention. Sensor 80 is adapted to sense multi-feeding of sheets and can comprise any conventional sensor, such as, the ultrasonic detector disclosed in U.S. Pat. No. 3,603,680, issued Sept. 7, 1971 to Edward D. Barton or the overlapped document detector as disclosed in U.S. Pat. No. 3,773,321 issued to Frank P. Burroughs on Nov. 20, 1973. As sheets are fed toward sensor 80, they are shingled and separated at the nip formed between retard pad 70 and belt 71. The retard pad and feed belt are electrically connected such that some potential difference is always present. If two or more sheets overlap through the nip and are fed past sensor 80, the sensor will actuate rheostat 81 that is grounded at 83 to increase the potential difference between retard pad 70 and feed belt 71 thereby increasing the frictional characteristics between the two members and the substrate being fed. The overlapped sheets will be separated due to this increase in electrostatic attraction at the nip and only one sheet at a time will be forwarded for further processing. The sensor 80 sensing only one sheet, will remove its signal to rheostat 81 thus returning the system to the original potential. Electrical energy is supplied to the system by battery 82.

This type of system increases the life expectancy of the feeder apparatus since the required potential increase is applied only when a multifeed is sensed. The pressure in the retard nip will be very low normally and be increased only when necessary to perform a separating task. With a low pressure normally in the retard nip, the durability of belt 71 and retard pad 70 will be considerably increased. The original pressure will be enough to supply most normal separating forces. The high friction condition will only be required for stress or multi-feed conditions. It should be understood that while the friction between the belt and retard pad is shown increased electrostatically, mechanical means could also be used to increase the pressure between the belt and pad on demand.

It has been found that elastomers can be made conductive by the insertion of carbon black. When a potential is then placed between, for example, a rubber slider and a metal plate, an increase in the coefficient of friction between the two was found to take place by as much as a factor of three. In FIG. 2, both the retard pad 70 and belt 71 are conductive and have a potential applied between them. This potential is increased when a slug of paper enters the nip formed between the feed belt 71 and retard pad 70 and is sensed by sensor 80. The increase in potential causes an increase in normal force created by electrostatic attraction between the belt and the pad and thereby enhances sheet separation. This system will work even if feed member 71 is a roller or if both members 70 and 71 are rollers.

Figure 3:
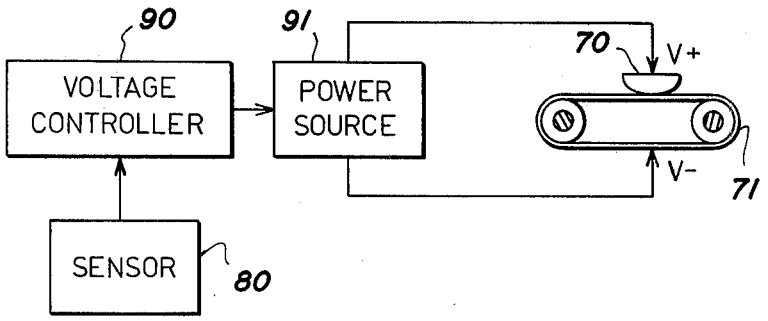
FIG. 3 is a diagramatic illustration of another aspect of the present invention.

In another aspect of the invention, as shown in FIG. 3, initially there is no energy applied to either the feed belt 71 or retard pad 70. The nip pressure is originally set according to characteristics of the sheets to be fed. When a multi-feed is sensed by sensor 80, conventional voltage controller 90 is actuated which in turn actuates and controls power source 91. This energization of belt 71 and retard pad 70 increases the effective friction force supplied by the materials and thereby increases the separating force of the feeder. Once the multi-feed has been separated, the signal from sensor 80 is removed from voltage controller 90 which in turn shuts off conventional power source 91 allowing the normal friction force between the belt and pad to return.

This system could also be used to control the frictional characteristics of the complete paper path in a copier. For example, elastomeric paper handling elements, such as transport rollers 90 and 91, in parts of the paper path other than the paper feeder could be optimally set for a desired coefficient of friction between the elements and the paper for a particular paper type and environment. If the original friction setting is later insufficient for proper paper transport due to a change in paper or environmental conditions, etc., optimum paper transport would still be easily obtained by sensing the need for a change and manually or automatically adjusting voltages appropriately.

In conclusion, the separating capability of a retard feed is highly sensitive to the pressure in the retard nip. This pressure can be attributed to the normal force present between the retard member and feed belt. Disclosed herein is an improvement to the conventional retard feeder that comprises increasing the nip separating force on demand by applying a potential difference between the belt and pad. Both materials are made of conductive elastomers and when the potential is applied, the effective friction force supplied by the material is increased significantly causing subsequent increases in the separating forces of the feeder. When the potential is removed, the friction force returns to its original level.

In addition to the method and apparatus disclosed above, other modifications and/or additions will readily appear to those skilled in the art upon reading this disclosure and are intended to be encompassed within the invention disclosed and claimed herein.

What is claimed is:

1. A method of minimizing sheet multi-feeds in a retard feeder having a feed member and a retard member forming a retard nip in the transport path of sheets characterized by the steps of:

(a) sensing a multi-feed; of sheets through the nip and (b) applying an electrical potential between the feed member and the retard member when a multi-feed is sensed thereby increasing the normal force between these members produced by the resultant electrostatic attraction therebetween to cause separation of the sheets in the nip.

2. A method of minimizing sheet multi-feeds in a retard feeder having a feed member and a retard member forming a retard nip in the transport path of sheets characterized by the steps of:

(a) sensing a multi-feed of sheets through the nip;

(b) applying an electrical potential between the feed member and the retard member when a multi-feed is sensed therey increasing the normal force between these members produced by the resultant electrostatic attraction therebetween to cause separation of the sheets in the nip; and (c) removing said potential upon separation of the multifeed.

3. The method according to claims 1 or 2 wherein the feed member and retard members are electrostatically conductive elastomers.

4. In a retard feeder having a substrate separation member and a retard member that cooperate to form a retard nip for the passage of substrates therethrough, the improvement characterized by:

sensing means located downstream of said nip and adapted to sense multi-feeding of substrates through said nip; and energizing means adapted to be actuated by a signal from said sensing means upon said sensing means sensing a substrate multi-feed, said energizing means upon receipt of said multi-feed signal applies an electrical potential between the feed member and the retard member, thereby increasing the coefficient of friction between the feed member and retard member by the increase in the normal force therebetween due to an increase in the electrostatic attraction between the feed member and the retard member.

5. The retard feeder according to claim 4 including control means for deactuating said energizing means when no multi-feed is sensed.

6. The retard feeder according to claim 4 wherein said feed member and said retard member are electrically conductive elastomers.

* * * * *